US009238857B2

(12) United States Patent
Kiuchi et al.

(10) Patent No.: US 9,238,857 B2
(45) Date of Patent: Jan. 19, 2016

(54) PRECIPITATION-STRENGTHENED NI-BASED HEAT-RESISTANT ALLOY AND METHOD FOR PRODUCING THE SAME

(71) Applicant: Kobe Steel, Ltd., Kobe-shi, Hyogo (JP)

(72) Inventors: Kiyoshi Kiuchi, Ibaraki (JP); Kiyoyuki Shiba, Ibaraki (JP); Tsuyoshi Noura, Kobe (JP); Jumpei Nakayama, Kobe (JP)

(73) Assignee: Kobe Steel, Ltd., Hyogo (JP)

( * ) Notice: Subject to any disclaimer, the term of this patent is extended or adjusted under 35 U.S.C. 154(b) by 371 days.

(21) Appl. No.: 13/904,897

(22) Filed: May 29, 2013

(65) Prior Publication Data

US 2013/0255843 A1 Oct. 3, 2013

Related U.S. Application Data

(63) Continuation of application No. PCT/JP2011/077718, filed on Nov. 30, 2011.

(30) Foreign Application Priority Data

Nov. 30, 2010 (JP) ..... 2010-266047

(51) Int. Cl.

| | |
|---|---|
| ***C22F 1/10*** | (2006.01) |
| ***C22C 19/05*** | (2006.01) |
| ***C22C 1/10*** | (2006.01) |
| ***C22C 32/00*** | (2006.01) |

(52) U.S. Cl.

CPC ..... *C22F 1/10* (2013.01); *C22C 1/1036* (2013.01); *C22C 19/055* (2013.01); *C22C 19/058* (2013.01); *C22C 32/0078* (2013.01)

(58) Field of Classification Search

CPC C22C 19/058; C22C 1/1036; C22C 32/0078; C22C 19/055; C22F 1/10

See application file for complete search history.

(56) References Cited

U.S. PATENT DOCUMENTS

2005/0084406 A1 4/2005 Ohtsuka et al.
2008/0206089 A1 8/2008 Norling

FOREIGN PATENT DOCUMENTS

JP 03-229840 10/1991
JP 2574497 B2 1/1997

(Continued)

OTHER PUBLICATIONS

International Search Report and Written Opinion of the International Searching Authority in corresponding International Application No. PCT/JP2011/077718, mailed Feb. 21, 2012, pp. 1-6.

(Continued)

*Primary Examiner* — Jessee Roe
(74) *Attorney, Agent, or Firm* — Studebaker & Brackett PC

(57) ABSTRACT

A precipitation-strengthened Ni-based heat-resistant alloy of the present invention includes 0.03 wt % or less of C, 0.5 wt % or less of Mn, 0.01 wt % or less of P, 0.01 wt % or less of S, 2.0 to 3.0 wt % of Si, 23 to 30 wt % of Cr, 7.0 to 14.0 wt % of W, 10 to 20 wt % of Fe, and 40 to 60 wt % of Ni, wherein a total content of C, N, O, P and S is 0.01 wt % or less. A silicide is dispersed and precipitated and a grain size of a matrix austenite is controlled through a thermo-mechanical treatment. As a result, the precipitation-strengthened Ni-based heat-resistant alloy excellent in irradiation resistance, heat resistance and corrosion resistance can be obtained with a low cost.

4 Claims, 10 Drawing Sheets

(56) References Cited

FOREIGN PATENT DOCUMENTS

| | | | |
|---|---|---|---|
| JP | 2000-129403 | A | 5/2000 |
| JP | 3753248 | B2 | 3/2006 |
| WO | WO 2006/003954 | A1 | 1/2006 |

OTHER PUBLICATIONS

The extended European search report issued by the European Patent Office on Oct. 30, 2014, which corresponds to European Patent Application No. 11845662.3-1362 and is related to U.S. Appl. No. 13/904,897.

A: G-Phase Stable Region; B: γ' Stable Region; C: $M_6C$ Coarsening Region

The stable temperature range of precipitates is the broadest in G-phase EHP alloy. The ductility reduction range of PE16 corresponds to that of $M_6C$.

Present Embodiment;
No Void Formation;
Cavity Alone;
Swelling Amount: 0.01% or less γ'-Phase Ni-Based EHP Alloy;
Void Formation Only Under Co-irradiation with He;
Swelling Amount: 0.2% (Equivalent to that of PE16)

PNC316 Steel;
Many voids Formed;
Swelling Amount: 3.4%

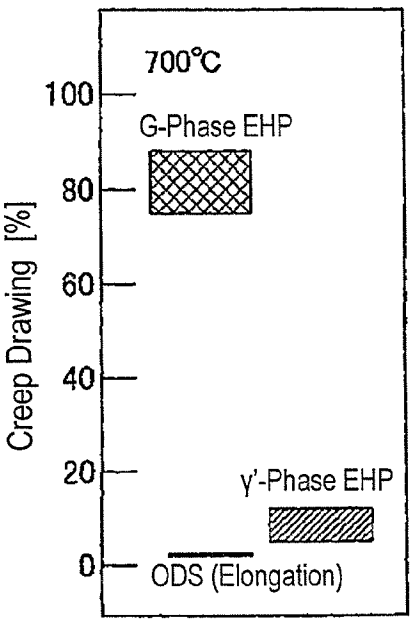
G-phase had a high drawing value even at 700°C at which conventional γ-phase materials of PE16 or the like was problematic (ODS had an elongation of only a few % or less, and had no ternary creeping).
FIG. 7
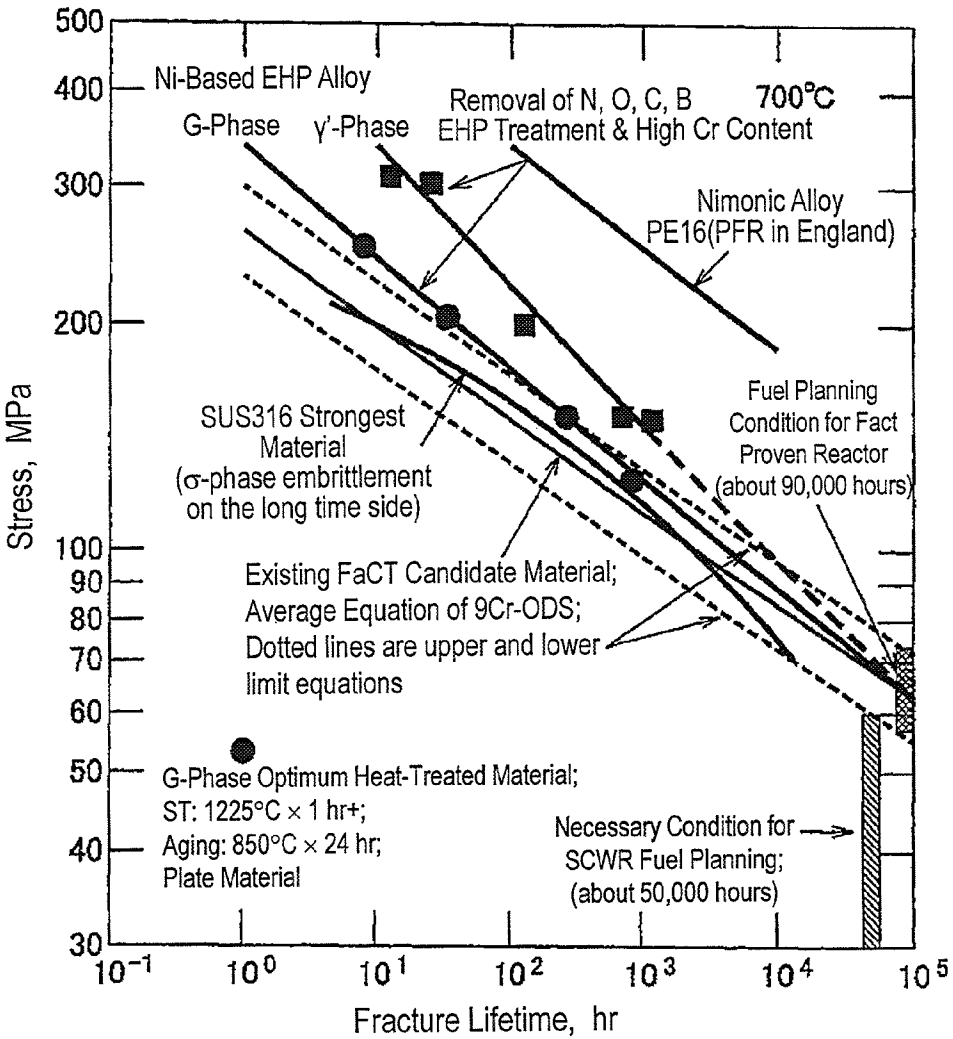

PRECIPITATION-STRENGTHENED NI-BASED HEAT-RESISTANT ALLOY AND METHOD FOR PRODUCING THE SAME

TECHNICAL FIELD

The present invention relates to a precipitation-strengthened Ni-based heat-resistant alloy usable as a material for fuel-cladding pipes of fast reactors, and to a method for producing the same.

BACKGROUND ART

Core materials for fast reactors are required to have excellent resistance to creep deformation and environment-induced cracking at high temperatures in high-radiation environments. In a prototype reactor Monju, used is an SUS316 austenitic stainless steel for the fuel-cladding pipes to which the most stringent conditions are applied among core materials for fast reactors.

As the abrasion-resistant high-strength members of light-water reactors, used is Stellite or Inconel; however, regarding Stellite, radioactivation associated with the Co-based alloy is an important issue in maintenance, and regarding Inconel, grain-boundary stress corrosion cracking is an important issue. As a candidate of a material for fuel-cladding pipes of supercritical water-cooled reactors, a SUS310 steel is exemplified; however, on a high-temperature side at 700° C., the austenite phase stability thereof is low, and therefore α-phase brittlement is an important issue.

FIG. 9 shows a relationship between TTC (aging time-temperature-corrosion range) diagrams relating to aging embrittlement of an SUS316 steel austenite (γ phase) and the γ phase stability thereof. In the left-hand chart, IGC is grain-boundary corrosion relating to the formation of a σ phase and a Cr-depleted layer of carbide in a grain boundary, and MPC (Martensite Path Corrosion) is a depression region of corrosion resistance at a grain boundary and within a grain, which is accompanied by the formation of a high-Cr plane and a low-Cr plane on a crystal plane level through spinodal decomposition of processing-induced martensite or remanent ferrite, which is generated depending on a heat hysteresis of cold working or the like and the aging time. This is because the γ phase itself is low in stability in a supercooled state and structure change is occurred during aging in a practical temperature range, as in the right-hand chart.

In a fast reactor of a high-temperature operation, a heat-resistant alloy resistant to high temperatures on a level of 700° C. is needed for the heat-transfer pipes of a heat exchanger; but existing Inconel 690 and the like are not precipitation-strengthened ones and the mechanical strength thereof is unsatisfactory.

Existing materials of austenitic stainless steel such as JIS SUS304 or SUS316 contain Cr in an amount of 16 wt % or more and may readily form a passivation film to exhibit excellent corrosion resistance, and in addition, the materials have excellent forming-workability and toughness intrinsic to face-centered cubic crystals, and are widely used as core structure materials for atomic reactors. However, these materials have a low Ni content of 20% or less, and therefore the thermodynamic stability of the austenite phase itself at operating temperatures is insufficient. Under the conditions of fast reactors that receive heavy irradiation by fast neutrons in a broad temperature range of from 250 to 700° C., the irradiation embrittlement is easily occurred in a low- or middle-temperature range of from 250 to 450° C., and deformation is easily occurred owing to volume change and irradiation creep by void swelling at 450° C. or higher. Consequently, the materials are insufficient in point of the heat resistance and the irradiation resistance, and are difficult to be applied to fast reactors.

FIG. 10 shows the influence of γ phase stability on irradiation resistance (void swelling resistance). The irradiation resistance is most excellent under the condition of Fe/Ni ratio at which γ phase is stabilized as a solid solution.

As alloys having improved irradiation resistance, austenitic stainless steels such as PNC316 and PNC1520 have been developed. By using these, the latent period before void swelling is controlled. However, after void swelling is occurred, the growth/coarsening of void occurs in proportion to the irradiance level (time), and therefore prototype reactors on an irradiance level of up to about 100 dpa are in the applicable range, and any other material more excellent in irradiation resistance is needed for practical reactors on an irradiance level of 250 dpa.

Given the situation, as a fuel-cladding pipe material for future fast reactors capable of solving the problems with existing austenitic stainless steels, studies and developments of precipitation-strengthened Ni-based heat resistant alloys are being made actively in Europe and America; and Nimonic Alloy PE16 used in prototype reactors in England, and new alloys created by modifying US Inconel-type commercial alloys have been developed. Patent Reference 1 discloses an Fe—Ni-based austenitic alloy excellent in neutron irradiation resistance and sodium corrosion resistance, which is used for core members of fast-breeder reactors such as fuel-cladding pipes.

As a technology of materials in another system for solving the problems with existing austenitic stainless steels, for example, a ferritic steel has been developed. A ferritic steel has a body-centered cubic crystal that hardly experience void swelling, and therefore mainly in US, HT9 or the like is being used for metal fuel-cladding pipes of fast reactors for use as breeder reactors operating at low temperatures. However, the mechanical strength at high temperature of ferritic steel is low as compared with that of austenitic steel; and therefore, the heat resistance thereof is problematic. Accordingly, Patent Reference 2 discloses a martensitic oxide dispersion steel (martensitic ODS steel) excellent in high-temperature strength.

CITATION LIST

Patent References

Patent Reference 1: JP-B-2574497
Patent Reference 2: JP-B-3753248

SUMMARY OF THE INVENTION

Problems that the Invention is to Solve

The Ni-based heat-resistant alloy such as PE16 which had been developed in England contains Ni in an amount of nearly 45 wt % and is intended to attain precipitation strengthening of the intermetallic compound of $Ni_3(Al,Ti)$-type regular phase referred to as γ' phase and the carbide such as $M_6C$ by addition of Mo and carbon. However, in the Ni-based heat-resistant alloy such as PE16, the intermetallic compound and the carbide coarsen and grow in the grain boundary at 700° C. that falls within a practical high temperature range for fuel-cladding pipes, and grain-boundary segregation of impurities is occurred and, in addition, since the precipitates are regular phase compounds, their effect of trapping He to be formed through nuclear transmutation reaction is small, and therefore the precipitates transfer into the grain boundary to easily generate bubbles; and owing to these contributing factors, the grain boundary becomes extremely brittle. Consequently, in practical use, the reduction in the ductility is an important issue. Accompanied with these properties, void swelling tends to occur therein.

In addition, the Ni-based heat-resistant alloy such as PE16 has the property that, at 800° C. or higher, the thermodynamic stability of the γ' phase itself of $Ni_3(Al,Ti)$ to be the main factor of precipitation strengthening rapidly lowers and the phase tends to readily dissolve. Accordingly, the precipitation strengthening temperature in the final heat hysteresis of the Ni-based heat-resistant alloy such as PE16 is around 750° C. and is low. In current development of fast reactors, the temperature during transient events in planning the prototype reactor Monju is 830° C., and the final heat treatment temperature that is to be the condition for the operating temperature range in safety regulation for practical reactors is required to be higher than that temperature.

Regarding the oxide dispersion strengthening-type ferritic steel, when the reactor is in a practical high-temperature range of 700° C., then the thermodynamic stability of the precipitates of carbide or oxide lowers owing to the influence of tritium to be formed through ternary fission of fuel and of hydrogen to be formed through nuclear transmutation reaction of the material constitutive nuclear species or owing to the increase in the reactivity of liquid metal sodium, and carbon or oxygen that constitutes the precipitates would diffuse away toward the primary cooling material side along with Cr, thereby readily providing significant metal structure change, which has been found out in use experiences of ferritic steel and irradiation experiments of fuel pin in US. Consequently, the limit temperature for ferritic steel is regarded as 650° C.

In addition, ferritic steel has high sensitivity to hydrogen-induced cracking peculiar to body-centered cubic crystals and therefore faces an intrinsic risk that, on the side of low temperatures, hydrogen brittlement is readily occurred even by a minor amount of hydrogen, and on the side of high temperatures, brittlement of methane forming reaction that is referred to as hydrogen corrosion depending on the carbon activity by the Cr content is readily occurred. In addition, on the side of high temperatures, another risk is a concern that Na precipitates and diffuses on the surface as the mass transfer in the liquid metal sodium in the primary cooling system circuit, thereby causing austenization of ferritic steel to greatly lower the irradiation resistance. On the other hand, regarding the FCCI (Fuel Cladding Chemical Interaction) on the fuel side, the ferritic steel has a risk in that the Cr content thereof is small and a protective oxide film is difficult to be formed in point of the oxidation reaction and the chemical reactivity with FP (fission product).

The oxide dispersion strengthening type-containing ferritic steel has the property that a brittle σ phase could be readily formed on the side of high temperatures in view of the phase stability of ferrite or martensite, but on the side of low temperatures, spinodal decomposition could readily occur; and therefore, the Cr content is limited to be 12 wt % or less, or that is, the steel could not contain Cr in an amount of 16% or more that is necessary for passivation in actual environments. Consequently, the steel is unsuitable in corrosion environments such as high-temperature air or water/moisture environments, and use of the steel may provide some trouble during storage in water and during wet-type reprocessing in a nuclear fuel cycle process. Consequently, in US, use of ferritic steel is limited to metal fuel-cladding pipes of fast reactors for use as breeder reactors or nuclear transmutation reactors to be operated at low temperatures of 650° C. or less. In other words, there is a history that ferritic steel has been developed for nuclear fuel cycle systems including dry storage of inert gas and wet-type reprocessing that differ from existing ones. Accordingly, in order to secure the corrosion resistance necessary for high-temperature operating fast reactors that are required to satisfy excellent power generation efficiency as the essential technology on the extended line of existing light-water reactor systems of our country, or for the nuclear fuel cycle system that includes storage in water, wet-type reprocessing and the like, use of the oxide dispersion strengthening-type ferritic steel and the like is significantly limited for the technical reasons.

On the other hand, the ODS steel is produced according to a small-capacity batch system accompanied by powder metallurgy, and is unsuitable for industrial-scale mass-production, or that is, the steel has an economic problem. In addition, the ODS steel is a composite material and has a technical difficulty in non-destructive inspection.

The technical problems with existing materials are compared in Table 1.

TABLE 1

| Name of Alloy | FMS | ODS | SUS316 | Improved SUS | High-Ni Alloy |
|---|---|---|---|---|---|
| Crystal System | high-Cr ferritic/martensitic bcc steel | | low -------- fcc-type γ phase stability ------ high | | |
| Material under Current Application Examination | 9Cr,12Cr 16-23Cr | 9Cr &12Cr-based $Y_2O_3$ dispersion | PNC316 | PNC1520 | Mainly practical alloys such as Inconel 706, 625 and PE16. |
| Background for Selection | SUS316 backup material | US Fe-based ODS (since 1980) | US technical results In candidate Monju | Experiences of British AGR fuel, etc. | High-creep strength Ni-based alloy |
| Properties | Excellent swelling resistance of bcc steel | | SUS rich in utility experiences | γ phase stability is higher than the case of 316. | Swelling resistance & high-creep strength |
| Development Target | High-temperature creep strength | High-temperature creep strength | Swelling resistance | High-temperature strength swelling resistance | Investigation of applicability of superalloy |
| Alloy Planning | Structure control by use of phase transition | Oxide dispersion, excessive oxygen precipitation effect | Preparation of minor ingredient for retardation of swelling latent period | Preparation of minor ingredient and improvement of γ phase stability | Securement of γ phase stability and FCCI resistance |
| Evaluation Results | Application condition is | Securement of irradiation resistance | Swelling control limit is existed in | Swelling resistance and ductility | Example of composition choice: |

TABLE 1-continued

| Name of Alloy | FMS | ODS | SUS316 | Improved SUS | High-Ni Alloy |
|---|---|---|---|---|---|
| | limitative owing to high-temperature creep. | and high-temperature creep strength at target temperature in actual reactors | transition regime expansion method. | reduction of middle- or low-temperature | 15Cr-(35/45)Ni-based Mo/W-controlled Ni-added steel |
| Problem | Significant limitation on wet-type reprocessing (possibility for mild dissolution condition for high burnup fuel, MOX fuel and for applicability of mechanical decladding, etc.) Ductility reduction in middle- or low-temperature range intrinsic to high-Cr steel (limitation of absorption energy of cladding pipe, etc.) | | Steady swelling rate is large. | About 150 dpa is limitative. | Inhibition of grain boundary brittlement is necessary. |
| | Inhibition of mass transfer accompanied by chemical potential difference between different materials in liquid metal sodium circuit | | | | |

In future, it would be necessary to construct nuclear fuel cycle systems that are centered on high-temperature operating fast reactors in place of existing power generation reactors. From the above-mentioned viewpoints, for the MOX fuel cladding pipes for use in those reactors, it is necessary to satisfy not only the irradiation resistance and the heat resistance but also the compatibility with the liquid metal sodium of the primary cooling material and fuel, and in addition, the pipes are also required to have excellent corrosion resistance in air under radiation action in a nuclear fuel cycle process, in storage in water or in the process of dissolution of used fuel with nitric acid, etc., and further, it is necessary that the cost for use in power generation reactors is not more than 2 times the current cost; and it is desired to establish high-performance material technology capable of comprehensively satisfying the irradiation resistance, the heat resistance, the corrosion resistance and the cost performance.

An object of the present invention is to provide a precipitation-strengthened Ni-based heat-resistant alloy excellent in irradiation resistance, heat resistance, corrosion resistance and cost performance, and a method for producing the same.

Means for Solving the Problems

The precipitation-strengthened Ni-based heat-resistant alloy of the present invention includes, in terms of wt %, 0.03% or less of C, 0.5% or less of Mn, 0.01% or less of P, 0.01% or less of S, from 2.0 to 3.0% of Si, from 23 to 30% of Cr, from 7.0 to 14.0% of W; from 10 to 20% of Fe, and from 40 to 60 wt % of Ni, wherein a total content of C, N, O, P and S is 0.01 wt % or less, and a silicide is dispersed and precipitated and a grain size of a matrix austenite is controlled to be a predetermined grain size. Regarding the content of C, Mn, P and S, and the total content of C, N, O, P and S, the lower limit thereof is 0 wt %.

According to the above-mentioned constitution, the void swelling depends on the stability of the austenite phase. Accordingly, as a measure of increasing the stacking-fault energy that governs the easiness of void formation by lowering the electron hole concentration, it is indispensable to increase the Ni content. In consideration of the fact that, owing to the generation of radiation-induced segregation (RIS) under heavy irradiation condition, the Cr concentration in the grain boundary lowers by around 10% than that in the matrix, it is necessary to fully increase the Cr content. Consequently, the composition is made to have a high Ni content and a high Cr content. The irradiation resistance and corrosion resistance can be secured by the control of the basic alloy composition.

The Ni-based heat-resistant alloy has great deformation resistance in the grain boundary, and therefore when the residual amount of impurities having a great effect of interfering with metal bonds, such as P, S, B, alkali metals and halogens that lower the mechanical properties in the grain boundary is high, then the sensitivity to solidification cracking or high-temperature cracking increases and the sensitivity to grain-boundary stress corrosion cracking or hydrogen embrittlement in environment-induced cracking increases. Consequently, the total content of C, N, O, P and S is 0.01 wt % or less. Accordingly, the mechanical properties and corrosion resistance in the grain boundary can be secured.

An intermetallic compound for attaining dispersion precipitation strengthening that is important for keeping a high-temperature creep strength is required to have sufficient thermodynamic stability in a broad temperature range of up to 900° C.

For the intermetallic compound capable of keeping high-temperature creep strength and being hardly dissolved under heavy irradiation, the γ' phase of PE16 and the like is unsuitable. Accordingly, from the knowledge that the stable precipitate of an austenitic stainless steel after heavy irradiation is a silicide referred to as G phase, Si itself has an effect of preventing void swelling, and of silicides, W—Si-based ones have the lowest solubility in a high-temperature range, a silicide such as tungsten silicide having high thermodynamic stability can be used as the intermetallic compound. The silicide is dispersed and precipitated therein and the grain size of the matrix austenite is controlled to be a predetermined grain size, whereby the high-temperature creep strength can be secured.

By using hot extrusion in the production process for existing commercial-level fuel-cladding pipes, mass-production of fuel-cladding pipes is possible here, and therefore, the cost performance of commercial-level power generation reactors can be satisfied.

Consequently, it is possible to provide the precipitation-strengthened Ni-based heat-resistant alloy excellent in irradiation resistance, heat resistance, corrosion resistance and cost performance.

In the precipitation-strengthened Ni-based heat-resistant alloy of the present invention, the silicide may be tungsten silicide. According to the above-mentioned constitution, in the silicides, W—Si-based ones have the lowest solubility in a high-temperature range, and therefore the high-temperature creep strength can be suitably secured through dispersion and precipitation of tungsten silicide having high thermodynamic stability.

In the precipitation-strengthened Ni-based heat-resistant alloy of the present invention, the silicide may be dispersed and precipitated within a range of from 20 to 40 vol %. According to the above-mentioned constitution, a precipitation-strengthened Ni-based heat-resistant alloy more excellent in high-temperature creep strength properties can be provided.

The method for producing a precipitation-strengthened Ni-based heat-resistant alloy of the present invention includes: an extra high purity ingot-forming step of forming a steel ingot by smelting a raw material so as to have a composition including, in terms of wt %, 0.03% or less of C, 0.5% or less of Mn, 0.01% or less of P, 0.01% or less of S, from 2.0 to 3.0% of Si, from 23 to 30% of Cr, from 7.0 to 14.0% of W, from 10 to 20% of Fe, and from 40 to 60 wt % of Ni, wherein a total content of C, N, O, P and S is 0.01 wt % or less; and a thermo-mechanical treatment step of subjecting the steel ingot to a thermo-mechanical treatment to disperse and precipitate a silicide therein and to control a grain size of a matrix austenite to be a predetermined grain size.

According to the above-mentioned constitution, the void swelling depends on the stability of the austenite phase. Accordingly, as a measure of increasing the stacking-fault energy that governs the easiness of void formation by lowering the electron hole concentration, it is indispensable to increase the Ni content. In consideration of the fact that, owing to the generation of radiation-induced segregation referred to as RIS under heavy irradiation condition, the Cr concentration in the grain boundary lowers by around 10% than that in the matrix, it is necessary to fully increase the Cr content. Consequently, the composition of the alloy is made to have a high Ni content and a high Cr content. The irradiation resistance and corrosion resistance can be secured by the control of the basic alloy composition.

The Ni-based heat-resistant alloy has great deformation resistance in the grain boundary, and therefore when the residual amount of impurities having a great effect of interfering with metal bonds, such as P, S, B, alkali metals and halogens that lower the mechanical properties in the grain boundary is high, then the sensitivity to solidification cracking or high-temperature cracking increases and the sensitivity to grain-boundary stress corrosion cracking or hydrogen embrittlement in environment-induced cracking increases. Consequently, the total content of C, N, O, P and S is 0.01 wt % or less. Accordingly, the mechanical properties and corrosion resistance in the grain boundary can be secured.

An intermetallic compound for attaining dispersion precipitation strengthening that is important for keeping a high-temperature creep strength is required to have sufficient thermodynamic stability in a broad temperature range of up to 900° C. For the intermetallic compound capable of keeping high-temperature creep strength and being hardly dissolved under heavy irradiation, the γ' phase of PE16 and the like is unsuitable. Accordingly, from the knowledge that the stable precipitate of an austenitic stainless steel after heavy irradiation is a silicide referred to as G phase, Si itself has an effect of preventing void swelling, and of silicides, W—Si-based ones have the lowest solubility in a high-temperature range, a silicide such as tungsten silicide having high thermodynamic stability can be used as the intermetallic compound. The silicide is dispersed and precipitated therein and the grain size of the matrix austenite is controlled to be a predetermined grain size, whereby the high-temperature creep strength can be secured.

By using hot extrusion in the production process for existing commercial-level fuel-cladding pipes, mass-production of fuel-cladding pipes is possible here, and therefore, the cost performance of commercial-level power generation reactors can be satisfied.

Consequently, it is possible to provide the precipitation-strengthened Ni-based heat-resistant alloy excellent in irradiation resistance, heat resistance, corrosion resistance and cost performance.

In the production method for the precipitation-strengthened Ni-based heat-resistant alloy of the present invention, the silicide may be tungsten silicide. According to the above-mentioned constitution, in the silicides, W—Si-based ones have the lowest solubility in a high-temperature range, and therefore the high-temperature creep strength can be suitably secured through dispersion and precipitation of tungsten silicide having high thermodynamic stability.

In the production method for the precipitation-strengthened Ni-based heat-resistant alloy of the present invention, the silicide may be dispersed and precipitated within a range of from 20 to 40 vol %. Further, it is desirable that the grain size of the matrix austenite is controlled to fall within a range of from No. 2 to No. 6 as ASTM grading scale. According to the above-mentioned constitution, a precipitation-strengthened Ni-based heat-resistant alloy more excellent in high-temperature creep strength properties can be provided.

In the production method for the precipitation-strengthened Ni-based heat-resistant alloy of the present invention, the thermo-mechanical treatment step may include a step of subjecting to a solution treatment in a temperature range of from 1200 to 1300° C., a step of cold working within a range of a working ratio of 60% after the solution treatment, a step of subjecting to an aging precipitation treatment within a temperature range of from 500 to 650° C. after cold working, and a step of subjecting to a heat treatment for middle- or high-temperature recrystallization within a temperature range of from 750 to 950° C. after the aging precipitation treatment. According to the above-mentioned constitution, in the low- or middle-temperature range of from 250 to 450° C. that requires abrasion resistance, the dispersion and precipitation of the silicide and the control of the grain size of the matrix austenite are intended to be attained through the thermo-mechanical treatment of a combination of cold working, aging precipitation treatment and middle- or high-temperature recrystallization. With that, the applicability of the alloy to actual environments at 250° C. to 450° C. that require abrasion resistance can be secured.

In the production method for the precipitation-strengthened Ni-based heat-resistant alloy of the present invention, the thermo-mechanical treatment step may include a step of cold working within a range of a working ratio of 60%, a step of subjecting to a solution treatment in a temperature range of from 1200 to 1300° C. after cold working, and a step of subjecting to aging precipitation treatment within a temperature range of from 750 to 900° C. after the solution treatment. According to the above-mentioned constitution, in the middle- or high-temperature range of from 450 to 700° C. that requires high-temperature creep strength, dispersion and precipitation of the silicide and the control of the grain size of the matrix austenite are intended to be attained through the thermo-mechanical treatment of a combination of cold working, solution treatment and aging precipitation treatment. With that, the applicability of the alloy to actual environments at 450° C. to 700° C. that require high-temperature creep strength can be secured.

Advantage of the Invention

According to the precipitation-strengthened Ni-based heat-resistant alloy of the present invention and its production method, irradiation resistance and corrosion resistance can be secured by the control of the basic alloy component, and high-temperature creep strength can also be secured by the dispersion and precipitation of the silicide. By using hot extrusion in the production process for existing commercial-level fuel-cladding pipes, mass-production of fuel-cladding pipes is possible. Consequently, the precipitation-strengthened Ni-based heat-resistant alloy excellent in irradiation resistance, heat resistance, corrosion resistance and cost performance can be provided.

(Composition of Precipitation-Strengthened Ni-Based Heat-Resistant Alloy)

Figure 1:
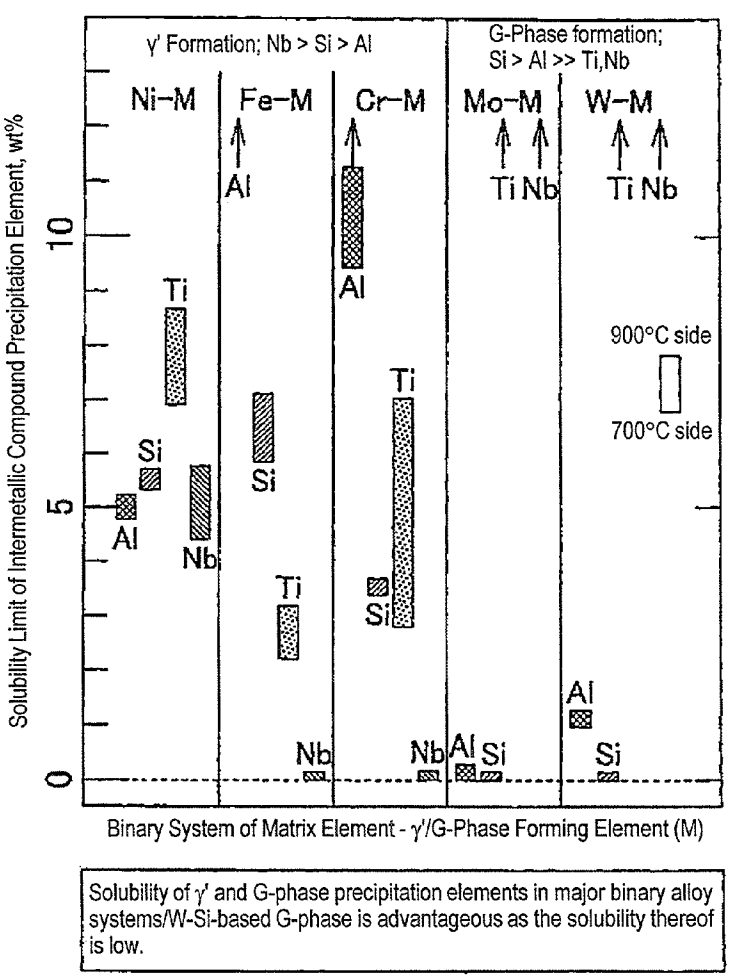
FIG. 1 shows the effectiveness of an alloy having a G-phase tungsten silicide as an intermetallic compound.

The precipitation-strengthened Ni-based heat-resistant alloy of an embodiment of the present invention (G-phase Ni-based EHP alloy) contains 0.03 wt % or less of C, 0.5 wt % or less of Mn, 0.01 wt % or less of P, 0.01 wt % or less of S, from 2.0 to 3.0 wt % of Si, from 23 to 30 wt % of Cr, from 7.0 to 14.0 wt % of W, from 10 to 20 wt % of Fe and from 40 to 60 wt % of Ni, wherein the total content of C, N, O, P and S is 0.01 wt % (100 wppm) or less. The G-phase Ni-based EHP alloy is produced by smelting a raw material according to the extra high purity ingot-forming method to be mentioned below, and further, a tungsten silicide is dispersed and precipitated within a range of from 20 to 40 vol % through the thermo-mechanical treatment. Table 2 shows the difference between the composition of the G-phase Ni-based EHP alloy of the present embodiment and those of existing comparative alloys. Except N, the impurity elements are analyzed through GD-MS (glow discharge-mass spectrometry) analysis.

TABLE 2

| Material | Fe | Cr | Ni | Mo | W | Si | Al,Ti, Zr,Nb | B* | C* | O* | N* | P* | S* | Remarks |
|---|---|---|---|---|---|---|---|---|---|---|---|---|---|---|
| G-phase Ni-based EHP alloy | (<20) | 25.2 (23-30) | 43.5 (40-60) | — | 10.4 (7-14) | 2.6 (2-3) | — | — | 23 (<30) | <5 | <5 | <5 | <5 | The present embodiment |
| PE16 | Bal. | 16.3 | 43.5 | 3.3 | — | 0.5 | 3.0 | 50 | 600 | — | — | — | — | PFR in England |
| PNC316 | Bal. | 16 | 14 | 2.5 | — | 0.7 | 0.2 (Ti,Nb) | 40 | 500 | — | — | <250 | <300 | Monju |
| 9Cr-ODS | Bal. | 9.0 | 0.01 | — | 2.0 | 0.05 | 0.22/Ti, 0.27/Y | — | 1500 | 1900 | 120 | <50 | <30 | FaCT candidate |

Figure 4:
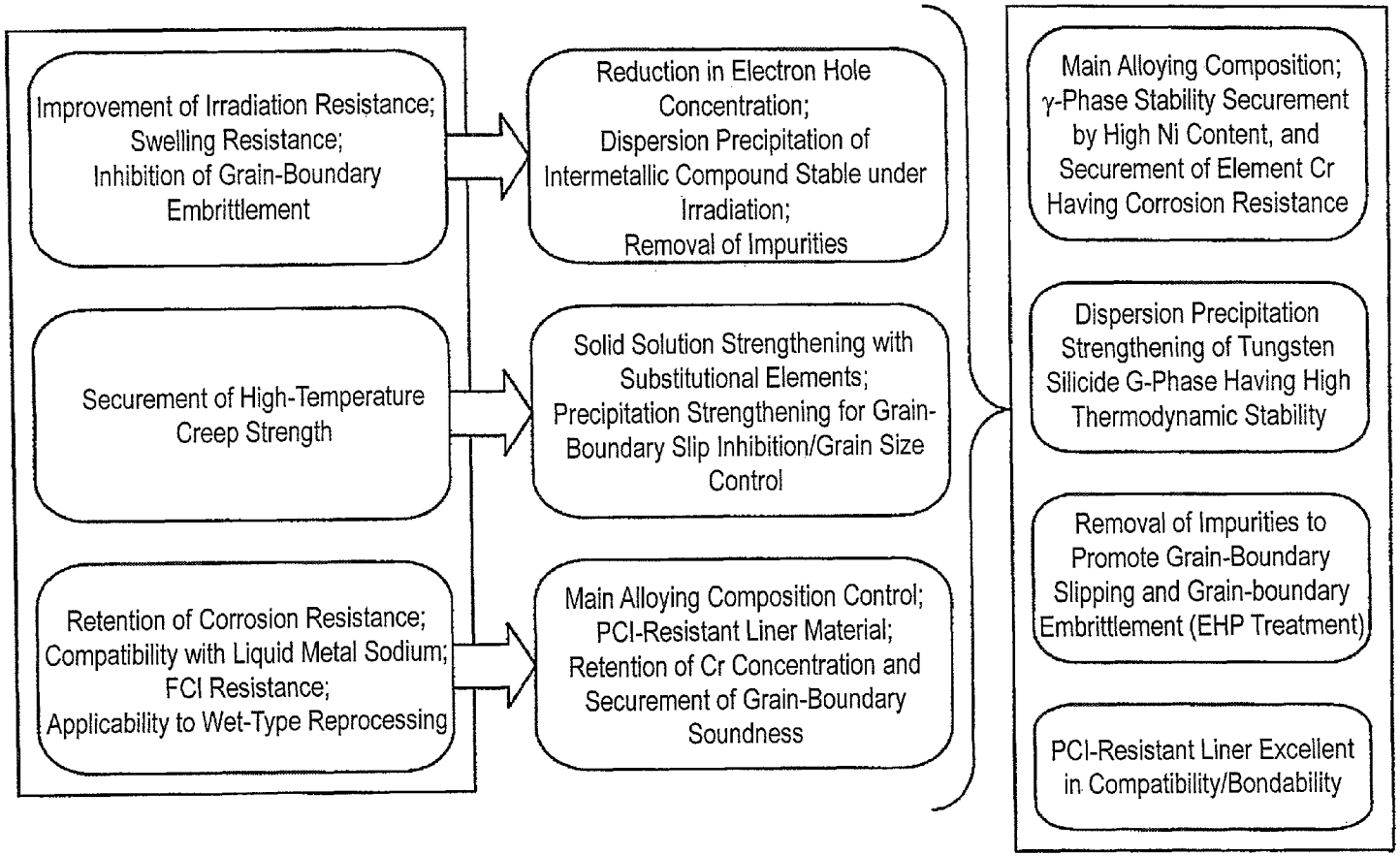

Numerical value: wt % (ppm for *)
Specification of EHP alloy: [C + O + N + P + S] < 100 ppm FIG. 4 shows the summary of the measure for improving the G-phase Ni-based EHP alloy of an embodiment of the present invention.

Figure 5:
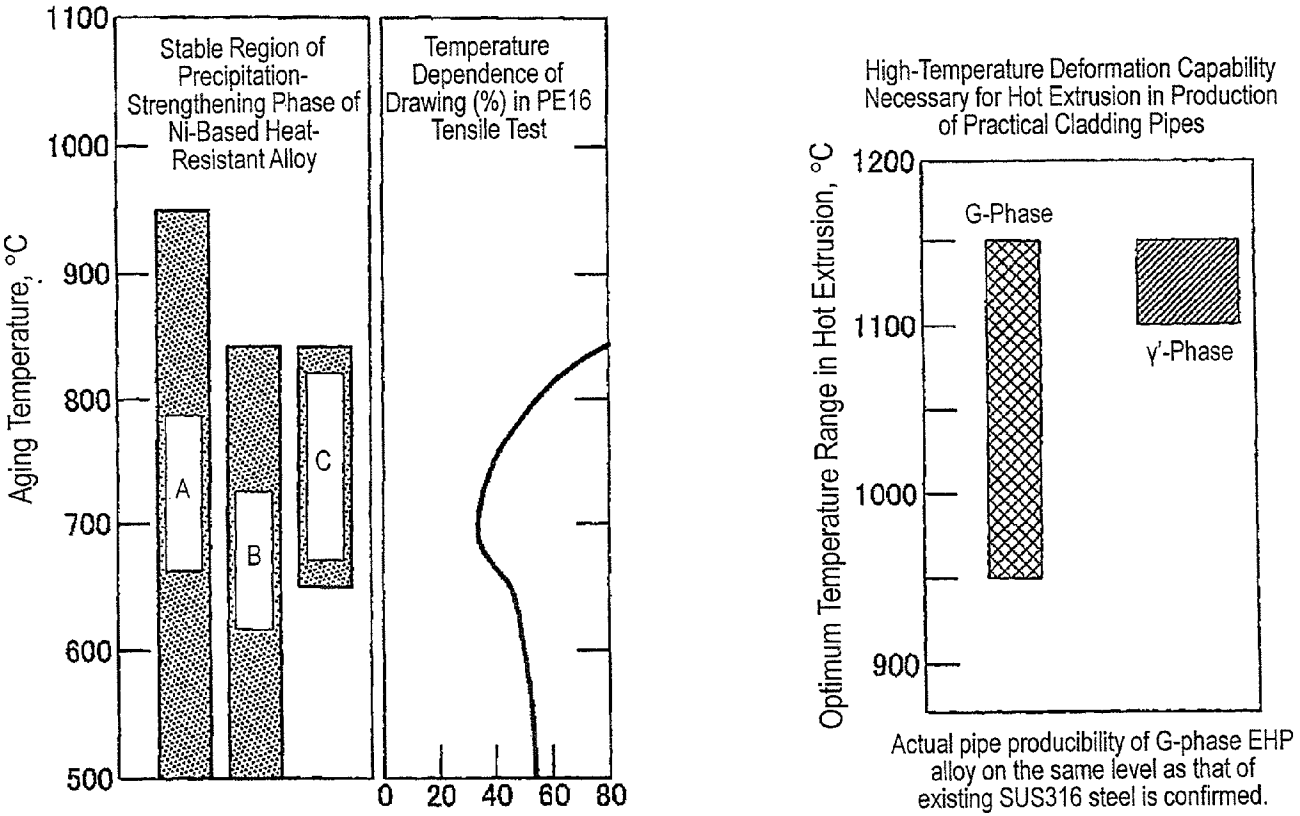

FIG. 5 shows evaluation examples of aging precipitation behavior and high-temperature deformation capability of the G-phase Ni-based EHP alloy of an embodiment of the present invention.

Figure 6:
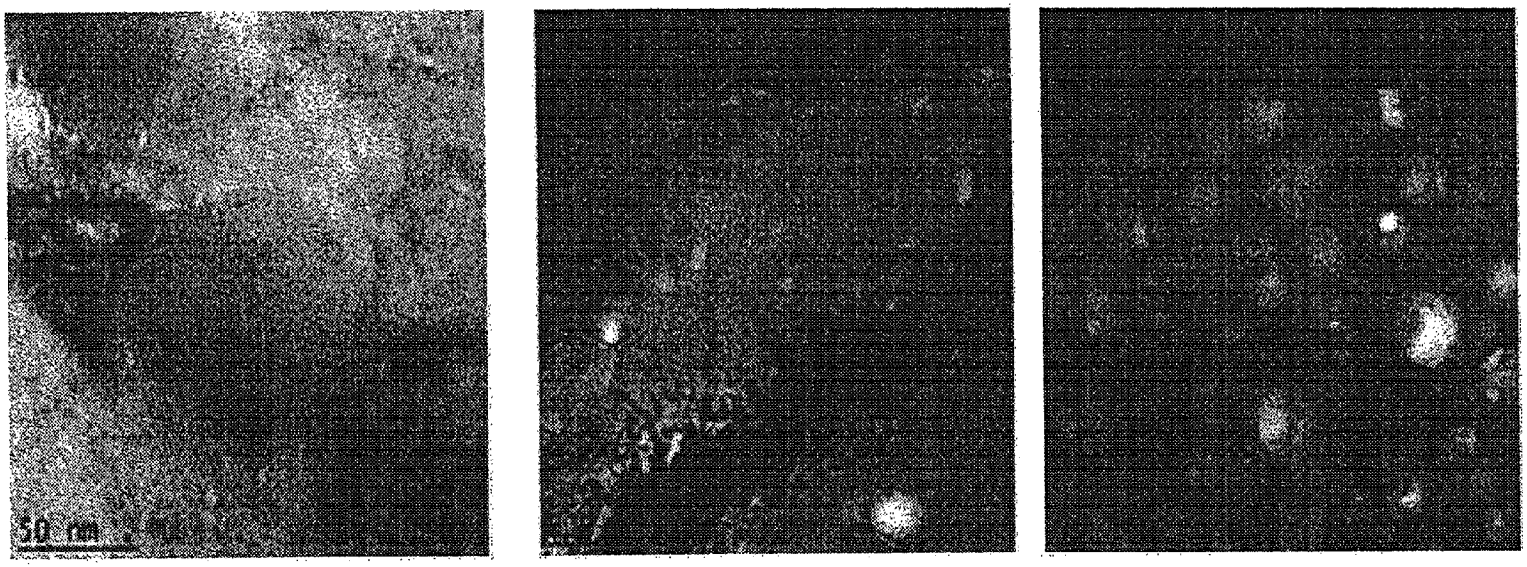

FIG. 6 shows evaluation examples of comparing the G-phase Ni-based EHP alloy of an embodiment of the present invention and an existing comparative alloy in point of the irradiation resistance.

FIG. 7 shows evaluation examples of comparing the G-phase Ni-based EHP alloy of an embodiment of the present invention and an existing comparative alloy in point of the high-temperature creep properties.

Figure 8:
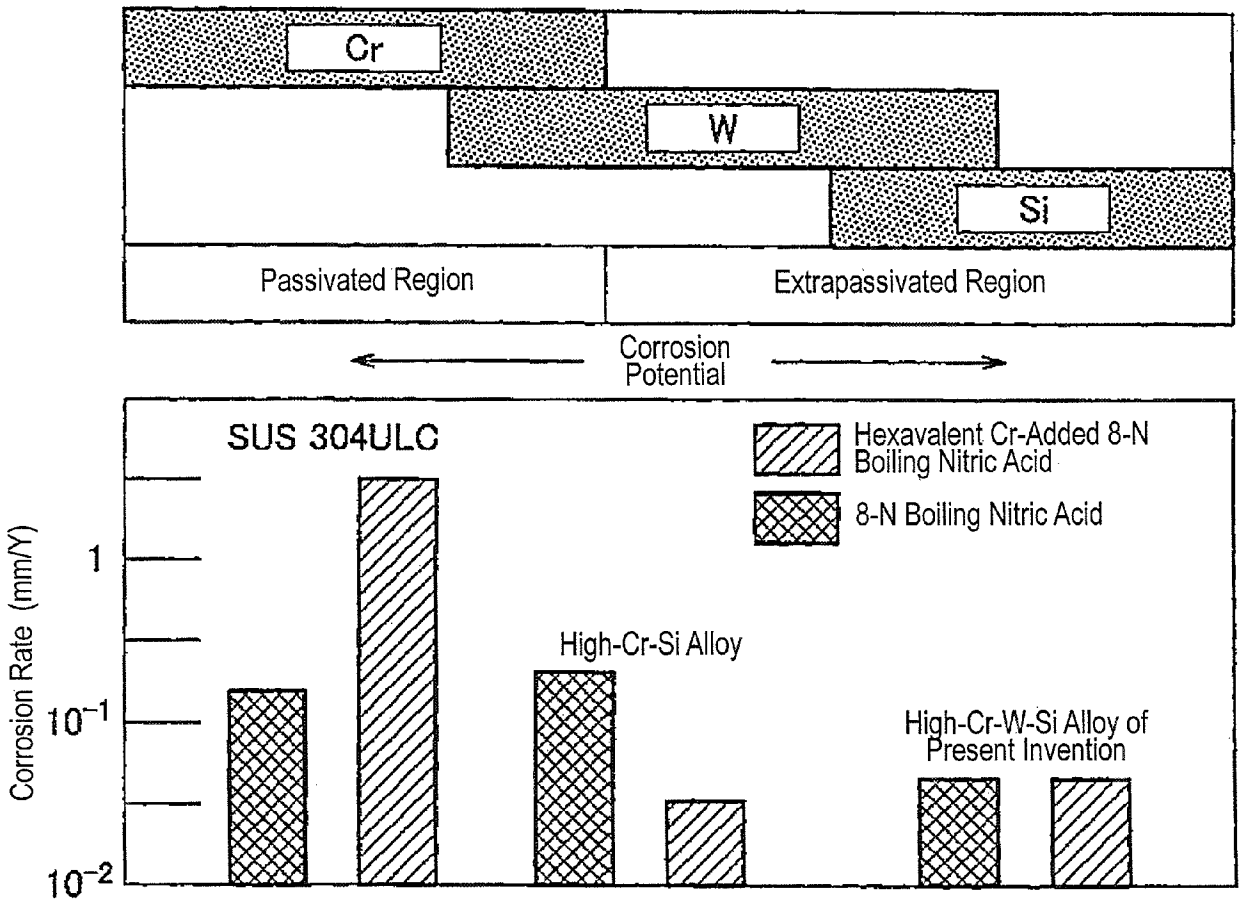

FIG. 8 shows examples of corrosion resistance of the G-phase Ni-based EHP alloy of an embodiment of the present invention.

Figure 9:
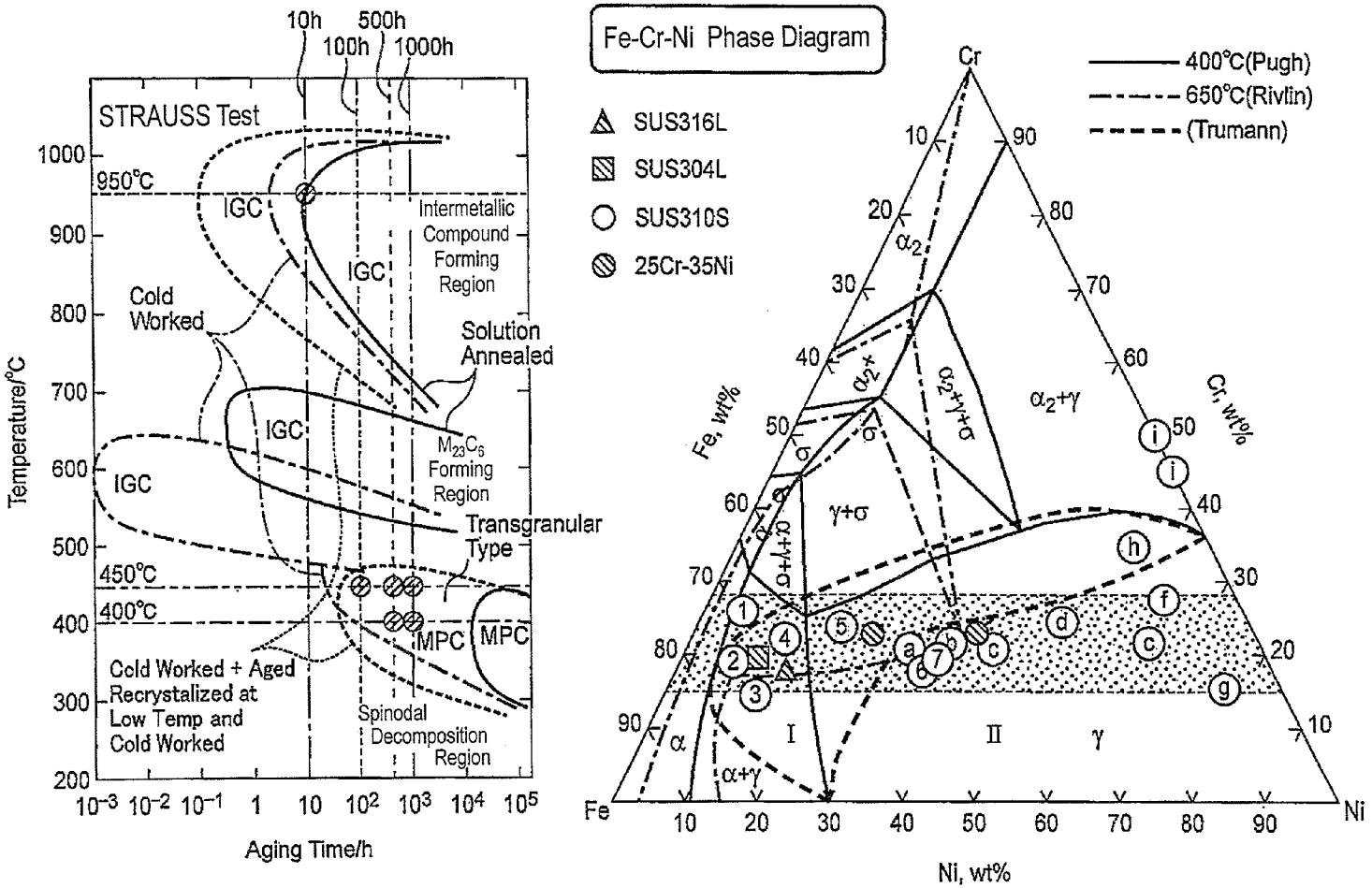

FIG. 9 shows a relationship between TTC (aging time-temperature-corrosion range) diagrams relating to aging embrittlement of an SUS316 steel austenite (γ phase) and the γ phase stability thereof.

Figure 10:
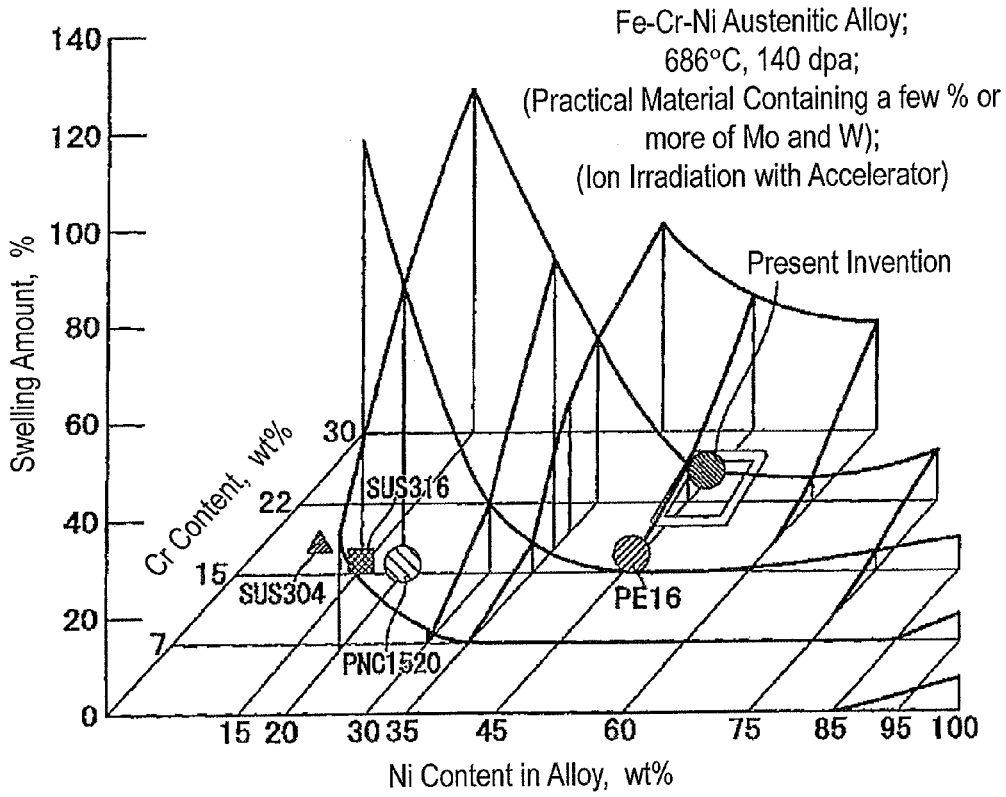

FIG. 10 shows an influence of γ phase stability on irradiation resistance.

EMBODIMENTS FOR CARRYING OUT THE INVENTION

Embodiments of the present invention are described below with reference to the drawings.

Void swelling depends on the stability of the austenite phase. Accordingly, as a measure of increasing the stacking-fault energy that governs the easiness of void formation by lowering the electron hole concentration, it is indispensable to increase the Ni content. In consideration of the fact that, owing to the generation of radiation-induced segregation referred to as RIS under heavy irradiation condition, the Cr concentration in the grain boundary lowers by around 10% than that in the matrix, it is necessary to fully increase the Cr content.

The reason why the acceptable range of the major components Ni, Cr, Fe, Si and W and the impurities in the G-phase Ni-based EHP alloy of the present embodiment is defined as in the above is as follows.

Regarding Cr, the content thereof is from 23 to 30 wt % from the viewpoint of fully securing the corrosion resistance in long-term storage in water and wet-type reprocessing of used fuel-cladding pipes in fast reactors, and stabilizing the austenite phase without causing the formation of secondary phase such as a σ or α-Cr that deteriorates irradiation resistance.

Regarding Fe, the content thereof is suitably controlled to fall within a range of from 10 to 20 wt % in consideration of the fact that He is readily formed through two-stage reaction with Ni depending on the neutron spectrum and temperature condition of the atomic reactor to which the alloy is applied, and in consideration of the condition under which the austenite phase could be mostly stabilized as a solid solution in the Fe—Cr—Ni-based alloy.

Regarding Ni, the content thereof is controlled to fall within a range of from 40 to 60 wt % in consideration of the range of the amount of the above-mentioned alloying elements. The basic properties of irradiation resistance and corrosion resistance can be fully secured by the control of this basic alloy composition.

Si is added to the G-phase Ni-based EHP alloy of the present embodiment along with W for the reason that, as the properties of the alloy, Si serves as an alloying element for securing high-temperature creep strength without deteriorating the ductility. Here, as an intermetallic compound having high thermodynamic stability, γ'-type PE16 and silicide-type G phase are mentioned. Silicide is a compound of metal and silicon. The G phase includes tungsten silicide and $Ni_3Si$. FIG. 1 shows the effectiveness of the alloy containing G-phase tungsten silicide as the intermetallic compound. The G-phase tungsten silicide has high thermodynamic stability and is hardly dissolved up to a high-temperature range of 900° C., and is more excellent as an intermetallic compound for dispersion strengthening than existing γ'-type PE16 which is commercial-level Ni-based alloy or the like. Accordingly, the G phase of a combination of W and Si is the most effective as an intermetallic compound here. However, these elements additionally have a negative effect of lowering the eutectic temperature to cause solidification cracking. Taking these into consideration, the Si content is defined to fall within a range of from 2.0 to 3.0 wt %.

As an alloying element for heat-resistant alloys, W has a large metal ion radius and has a low diffusion rate, and is therefore effective as a solid-solution hardening element and, in addition, as described above, the G phase of a combination of W and Si is effective as an intermetallic compound serving as precipitation-strengthening elements. However, like Si, W also has a negative effect of increasing the solidification cracking sensitivity, and taking these into consideration, the W content is defined to fall within a range of from 7.0 to 14.0 wt %.

Further, Si itself has an effect of inhibiting void formation. In addition, W and Si have an excellent capability of oxide film formation even in corrosion environments with high oxidative-power, for example, in air under radiation action or in water environments in which a sufficient corrosion-resistant film can not be formed by Cr alone, and therefore addition of W and Si is effective for enhancing the corrosion resistance. In addition, the G-phase tungsten silicide can readily form a bulky irregular compound. Accordingly, while the γ'-type regular compound has a tendency of coarsening depending on the surface energy thereof to promote the grain-boundary embrittlement, the G-phase tungsten silicide does not have a tendency of coarsening depending on the surface energy thereof to promote the grain-boundary embrittlement, even in heavy irradiation conditions. In addition, the G-phase tungsten silicide has a great effect of trapping He to be formed through nuclear transmutation reaction, and is therefore effective for preventing helium embrittlement and also effective for totally enhancing the irradiation resistance.

The other elements than the above are all impurity elements. The limitative concentration of these elements is defined under the condition that, in aging in a period of use, the decrease of the ductility and decrease of the corrosion resistance are not caused by wakening the bonding force in the grain boundary of the austenite, and in comprehensive consideration of the easiness of the component segregation into the grain boundary and the purification limit in the commercial-level ingot-forming method to be mentioned below. Taking these into consideration, the most reasonable range is defined for these impurity elements. Of metals of substitutional solute elements, Mn that has a high effect of inhibiting the corrosion resistance is defined to be 0.5 wt % or less. Interstitial elements have a high capability of aging precipitation and segregation, and therefore, C is defined to be 0.03 wt % or less, P is defined to be 0.01 wt % or less and S is defined to be 0.01 wt % or less, and the total content of C, N, O, P and S is defined to be 0.01 wt % (100 wppm) or less, thereby securing the soundness of the austenite grain boundary under use conditions. In addition, under high-temperature conditions, depending on the difference of used temperature, the solubility of the impurities is large and the deformation behavior is toward grain boundary slip domination of diffusion creep, and taking these into consideration, the grain size of the austenite is preferably controlled to be a large grain diameter of not more than ASTM Grain Size, Number 7, through thermo-mechanical treatment. On the other hand, under low- or middle-temperature conditions, the grain size for exhibiting effective deformation resistance is preferably controlled to be a large grain diameter of not more than ASTM Grain Size, Number 7, from the viewpoint of mechanical strengthening. By these combined measures, both of inhibition of segregation of impurities and securement of mechanical strength are attained.

(Extra High Purity Ingot-forming Method)

Figure 2:
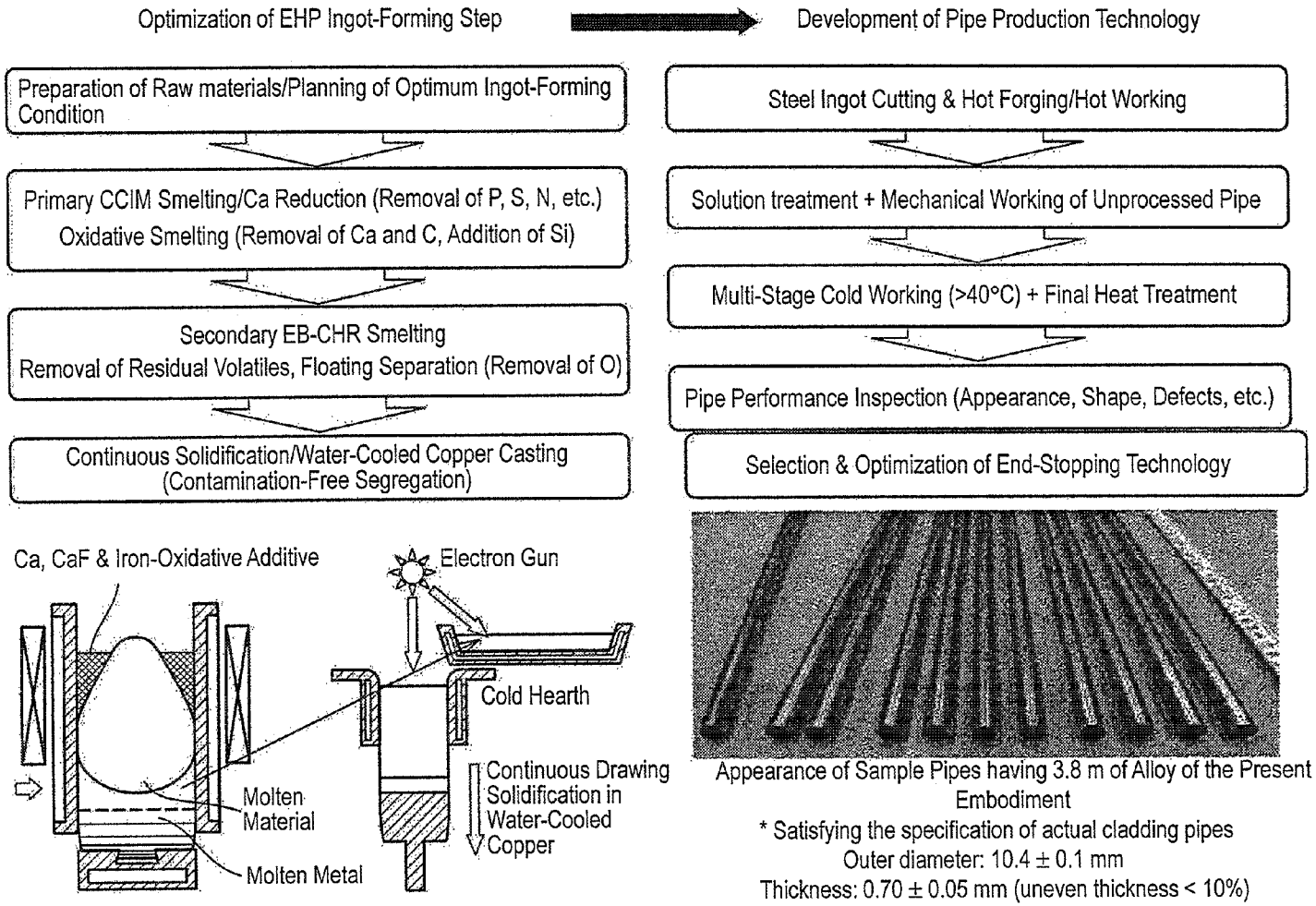
FIG. 2 shows an extra high purity ingot-forming method and an example of actual pipe production.

Next, the extra high purity ingot-forming method for producing the steel ingot of the G-phase Ni-based EHP alloy of the present embodiment will be described. The steel ingot of the G-phase Ni-based EHP alloy of the present embodiment can be produced by smelting a raw material according to an extra high purity ingot-forming method referred to as EHP using a two-stage smelting method (extra high purity ingot-forming step). In this step, harmful impurities such as B, alkali metals and halogen are minimized and their solidification segregation is inhibited. FIG. 2 shows the extra high purity ingot-forming method (EHP) and an example of actual pipe production.

The Ni-based heat-resistant alloy has great deformation resistance in the grains therein. Accordingly, in the Ni-based heat-resistant alloy, when the residual amount of the impurities having a great effect of interfering with metal bonding, such as P, S, B, alkali metals and halogens that lower the mechanical properties in the grain boundary, is high, then the sensitivity to solidification cracking or high-temperature cracking increase, and the sensitivity to grain-boundary stress corrosion cracking or hydrogen embrittlement in environment-induced cracking greatly increases. Consequently, in the present embodiment, in EHP, the total content of the interstitial elements that may readily segregate in the grain boundary, such as C, N, O, P and S, is defined to be 0.01 wt % (100 wppm) or less, and the composition is homogenized to secure the mechanical properties and the corrosion resistance in the grain boundary.

In EHP, according to a drawing down method of a water-cooled copper crucible, steel ingots are continuously solidified. Accordingly, the present invention is free from the trouble of solidification segregation and contamination from ceramic crucibles, which is problematic in the existing vacuum melting method such as VIM or VAR. Accordingly, steel ingots having a high cleanliness can be obtained. In addition, in EHP, the steel ingots to be obtained are large grains equivalent to one which has been subjected to a soaking treatment, and the EHP has the feature that intermediate products having a rectangular shape or a tabular shape depending on the intended use can be directly produced by melting. Accordingly, the product production process can be rationalized and the product reliability can be increased.

Concretely, in the former stage of EHP, a high-frequency induction melting furnace of a magnetic suspension system (CCIM) is used. Reductive smelting that uses Ca/CaF as a flux and oxidative smelting that uses an iron oxide as a flux are carried out. Accordingly, the nonvolatile impurities such as P, S, N, Ca and C can be efficiently removed, and the composition can be homogenized by the stirring effect of electromagnetic induction. In addition, since water-cooled copper crucibles are used, the system hardly undergoes secondary contamination.

Further, in the latter stage of EHP, the remaining volatile impurities such as O are removed according to an electron beam melting method using a cold hearth (EB-CHR), which is the most efficient volatilization smelting method. EHP is disclosed in the home page of Japan Atomic Energy Agency (http://jolisfukyu.tokai-sc.jaea.go.jp/fukyu/mirai/2008/10_1.html). Table 3 shows compositions for parameter evaluation of impurities-controlled states and added effects of alloying elements.

TABLE 3

| Ingot No. | Ni | Cr | Fe | Mo | W | Si | C* | O* | N* | P* | S* |
|---|---|---|---|---|---|---|---|---|---|---|---|
| 1 | Bal. | 25 | 18 | — | 10 | 2.7 | <30 | <5 | <5 | <5 | <5 |
| 2 | Bal. | 23 | 18 | — | 10 | 2.7 | <30 | <5 | <5 | <5 | <5 |
| 3 | Bal. | 27 | 16 | — | 10 | 2.7 | <30 | <5 | <5 | <5 | <5 |
| 4 | Bal. | 25 | 18 | — | 10 | 2.6 | <30 | <5 | <5 | <5 | <5 |
| 5 | Bal. | 24 | 18 | — | 10 | 2.7 | <30 | <5 | <5 | <5 | <5 |
| 6 | Bal. | 24 | 18 | — | 10 | 2.7 | <30 | <5 | <5 | <5 | <5 |
| 7 | Bal. | 25 | 18 | — | 10 | 2.6 | <30 | <5 | <5 | <5 | <5 |
| 8 | Bal. | 22 | 18 | — | 10 | 2.7 | <30 | <5 | <5 | <5 | <5 |
| 9 | Bal. | 21 | 18 | — | 10 | 2.7 | <30 | <5 | <5 | <5 | <5 |
| 10 | Bal. | 25 | 0 | — | 10 | 2.7 | <30 | <5 | <5 | <5 | <5 |
| 11 | Bal. | 25 | 0 | — | 8 | 2.0 | <30 | <5 | <5 | <5 | <5 |
| 12 | Bal. | 25 | 0 | — | 10 | 3.4 | <30 | <5 | <5 | <5 | <5 |
| 13 | Bal. | 30 | 0 | — | 13 | 2.4 | <30 | <5 | <5 | <5 | <5 |
| 14 | Bal. | 30 | 0 | — | 15 | 2.4 | <30 | <5 | <5 | <5 | <5 |
| 15 | Bal. | 30 | 0 | — | 18 | 2.4 | <30 | <5 | <5 | <5 | <5 |
| 16 | Bal. | 30 | 0 | — | 10 | 3.8 | <30 | <5 | <5 | <5 | <5 |
| 17 | Bal. | 30 | 0 | — | 10 | 4.1 | <30 | <5 | <5 | <5 | <5 |
| 18 | Bal. | 30 | 0 | — | 10 | 2.7 | <30 | <5 | <5 | <5 | <5 |

Numerical value: wt % (ppm for *)
Specification of EHP alloy: [C + O + N + P + S] < 100 ppm (Thermo-mechanical Treatment)

Next, the thermo-mechanical treatment to be applied to the steel ingot produced through EHP is described. In the G-phase Ni-based EHP alloy of the present embodiment, tungsten silicide is dispersed and precipitated through the thermo-mechanical treatment (thermo-mechanical treatment step). Here, the thermo-mechanical treatment is a processing step of carrying out the final plastic working within a given temperature range so as to make the material state having specific properties that could not be repeatedly obtained through mere heat treatment.

The intermetallic compound for attaining dispersion/precipitation strengthening that is important for maintaining high-temperature creep strength is required to have sufficient thermodynamic stability in a broad temperature range up to 900° C. Here, dispersion strengthening means the increase of the hardness caused by the disturbance of the grain structure in the matrix by the precipitated and dispersed grains; and precipitation strengthening means a method of heat-treating the alloy, to which elements to cause the precipitation have been added at high temperature to thereby dissolve these elements in the matrix, and thereafter heat-treating the alloy at a temperature lower than the temperature at which the elements have been dissolved, thereby precipitating the dissolved elements. For the intermetallic compound which is hardly dissolved under heavy irradiation, the γ' phase of PE16 or the like is unsuitable. Accordingly, from the knowledge that the stable precipitate of an austenitic stainless steel after heavy irradiation is a silicide referred to as G phase, Si itself has an effect of preventing void swelling, and of silicides, W—Si-based ones have the lowest solubility in a high-temperature range, tungsten silicide having high thermodynamic stability can be used as the intermetallic compound. The difference of the irradiation resistance between the G-phase Ni-based EHP alloy of the present embodiment and existing comparative alloys is shown in Table 4.

TABLE 4

| | Irradiation-Resistant Ni-Based Heat-Resistant Alloy | | Existing Comparative SUS Material |
|---|---|---|---|
| Alloy for Evaluation | The present embodiment | γ'-phase EHP alloy | PNC316 |
| Background of Material Development | World's first G-phase precipitation-strengthened Ni-based heat resistant alloy having plasticity and high-Cr—W—Si tungsten silicide, attained through EHP technology. | The problems of ductility reduction and swelling in PE16 applied to PFR in England are improved through removal of Mo and C and according to an EHP ingot-forming method. | Irradiation resistance was enhanced by controlling the minor components of C, P and the like in commercial SUS316. σ-phase precipitation relates to strengthening and embrittlement. |
| Mechanism of Securing Irradiation Resistance | The γ-phase is stabilized by reducing the ratio of (Fe + Cr)/Ni, and the swelling is prevented by increasing the stacking-fault energy. High-temperature strength is secured by dispersion strengthening of the γ' or G-phase in the intermetallic compound. For irradiation resistance, the high Cr-content and He formed from Ni through nuclear transmutation reaction are important. | | As this is semi-stable austenitic (γ-type) stainless steel, this has only the effect of extending the time before swelling generation (<70 dpa). |
| Problem in Evaluation of Irradiation Resistance | Having a low solubility even at high temperatures, and having an effect of enhancing irradiation resistance by the massive or tabular G phase or Laves. | Influence of properties of spherical γ'-phase that readily grows as Ostwald growth for interfacial energy control in a regular phase; He effect. | Steady swelling rate control after transition regime is difficult. |
| Irradiation Resistance on Low-Temperature Side of Irradiation Hardening Region | Secondary irradiation defects hardly grow, and even gaseous elements are trapped by fine defects for irradiation hardening. | Secondary irradiation defects such as dislocation loops readily grow, and interaction between gaseous elements and defects is problematic. | Secondary irradiation defects such as dislocation loops readily grow, and interaction between gaseous elements and defects is problematic. |
| Irradiation Resistance on High-Temperature Side of Void | It is confirmed that no void forms and only fine bubbles | Owing to He influence, voids or bubbles form. Helium | Large quantities of voids or bubbles are readily formed, and |

TABLE 4-continued

| | Irradiation-Resistant Ni-Based Heat-Resistant Alloy | | Existing Comparative SUS Material |
|---|---|---|---|
| Alloy for Evaluation | The present embodiment | γ'-phase EHP alloy | PNC316 |
| Swelling Region | form, and the alloy is free from He influence and has good swelling resistance. | embrittlement at high temperature is problematic. | swelling resistance is low. |

Here, the G-phase Ni-based EHP alloy to be used in a low- or middle-temperature range of from 250 to 450° C. and the G-phase Ni-based EHP alloy to be used in a middle- or high-temperature range of from 450 to 700° C. differ in point of the necessary requirement of mechanical properties. Concretely, the case of the low- or middle-temperature range of from 250 to 450° C. requires abrasion resistance, and the case of the middle- or high-temperature range of from 450 to 700° C. requires high-temperature creep strength.

Firstly, the thermo-mechanical treatment for the G-phase Ni-based EHP alloy to be used in a low- or middle-temperature range of from 250 to 450° C. in which the abrasion resistance is required will be described. First, in a temperature range of from 1200 to 1300° C., the G-phase Ni-based EHP alloy is subjected to a solution treatment preferably for 10 minutes or more. As a result, the austenite phase changes to a uniform solid solution. Next, within a range of a working ratio of 60%, the G-phase Ni-based EHP alloy is cold-worked. Subsequently, within a temperature range of from 500 to 650° C., the G-phase Ni-based EHP alloy is subjected to an aging precipitation treatment preferably for 20 hours or more. As a result, the grain size of the tungsten silicide is controlled suitably. Then, within a temperature range of from 750 to 950° C., the G-phase Ni-based EHP alloy is subjected to a heat treatment for middle- or high-temperature recrystallization preferably for 5 hours or more. As a result, the dispersion of tungsten silicide is strengthened, and the applicability of the resulting alloy to actual environments at from 250 to 450° C. in which the abrasion resistance is required is secured.

Figure 3:
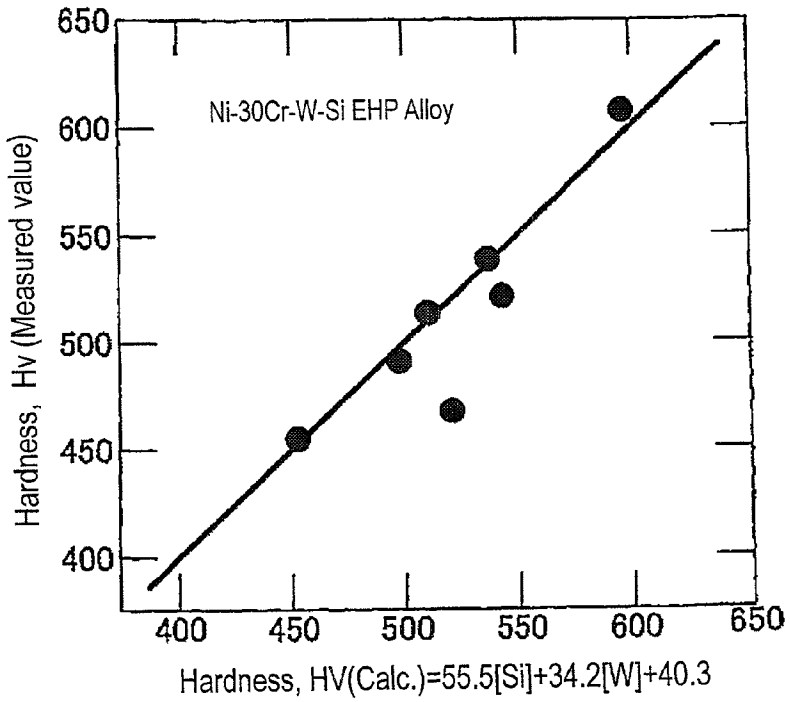
FIG. 3 shows evaluation examples of the warranty conditions of abrasion resistance through a composition of the G-phase Ni-based EHP (extra high purity) alloy of an embodiment of the present invention and thermo-mechanical treatment.
Figure 3:
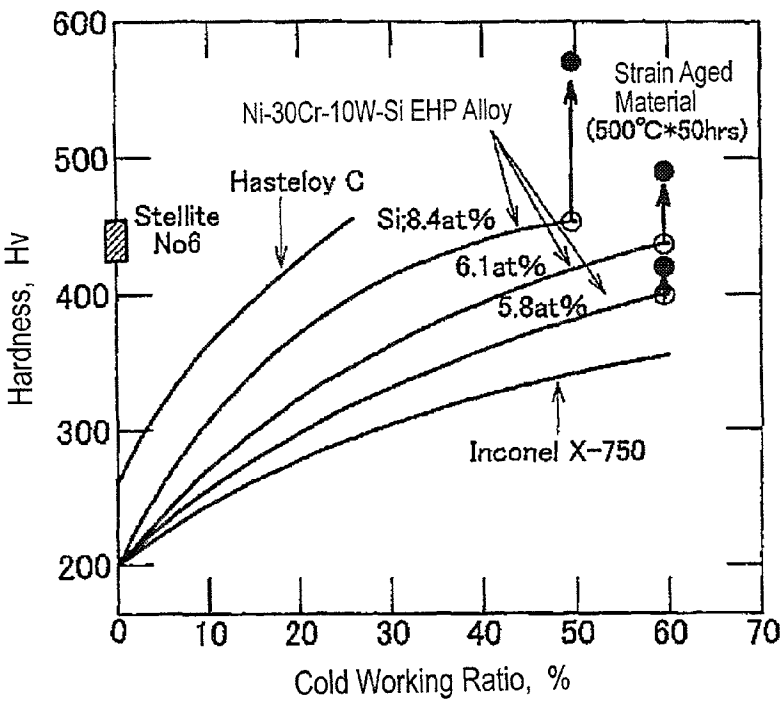

FIG. 3 shows evaluation examples of the warranty conditions of abrasion resistance by a composition of the G-phase Ni-based EHP alloy of the embodiment and a thermo-mechanical treatment. Under the low- or middle-temperature conditions requiring abrasion resistance, the precipitation state of the tungsten silicide can be controlled by controlling the concentration of W and Si and the thermo-mechanical treatment of a combination of cold working and aging precipitation treatment. Accordingly, alloys, the hardness of which is not lower than that of the cast alloy Stellite actually applied to existing power generation reactors, can be produced in any desired manner.

Next, the thermo-mechanical treatment for the G-phase Ni-based EHP alloy to be used in a middle- or high-temperature range of from 450 to 700° C. in which the high-temperature creep strength is required will be described. First, within a range of a working ratio of 60%, the G-phase Ni-based EHP alloy is cold-worked. Subsequently, within a temperature range of from 1200 to 1300° C., the G-phase Ni-based EHP alloy is subjected to a solution treatment preferably for 10 minutes or more. As a result, the grain size of the tungsten silicide is controlled suitably. Then, within a temperature range of from 750 to 900° C., the G-phase Ni-based EHP alloy is subjected to an aging precipitation treatment preferably for 20 hours or more. As a result, the dispersion of tungsten silicide is strengthened, and the applicability of the resulting alloy to actual environments at from 450 to 700° C. in which the high-temperature creep strength is required is secured.

As described above, the G-phase Ni-based EHP alloy of the present embodiment is secured to have improved irradiation resistance, high-temperature creep strength and corrosion resistance, as shown in FIG. 4. Concretely, by increasing the Ni content and the Cr content, the irradiation resistance and corrosion resistance are secured. By controlling the total content of C, N, O, P and S to 0.01 wt % (100 wppm) or less through an extra high purity ingot-forming method (EHP), the mechanical properties and the corrosion resistance in the grain boundary are secured. The tungsten silicide is dispersed and precipitated through the thermo-mechanical treatment, and then, the high-temperature creep strength is secured. In addition, since the tungsten silicide has an effect of trapping He, the irradiation resistance is thereby enhanced.

(Evaluation Test for High-temperature Deformation Capability)

Next, the results of the evaluation test for high-temperature deformation capability of the G-phase Ni-based EHP alloy of the present embodiment will be described.

For the materials to be applied to fuel-cladding pipes in fast reactors, it is necessary to mass-produce large quantities of highly-reliable fuel-cladding pipes on a commercial scale. From the evaluation test for high-temperature deformation capability thereof, it has been confirmed that the G-phase Ni-based EHP alloy of the present embodiment has good high-temperature deformation capability in an extremely broad temperature range in hot extrusion or hot drawing thereof, and the commercial-level fuel-cladding pipes can be produced on the same level as that of existing SUS316 steel, and on a laboratory scale, the cladding pipes having 4 m which is on a scale of actual pipes can be produced (see FIG. 2).

FIG. 5 shows evaluation examples of the aging precipitation behavior and high-temperature deformation capability of the G-phase Ni-based EHP alloy of the present embodiment. As in the left-hand chart, regarding the precipitation behavior of the G phase and γ' and $M_6C$, the temperature range of the G phase in which the thermodynamic stability is high is the broadest, and the ductility reduction of PE16 or the like overlaps with the precipitation range of $M_6C$. In the evaluation results of the high-temperature deformation capability in the right-hand chart, the temperature range in which the hot-workability of the G-phase Ni-based EHP alloy of the present embodiment is high is broad, and this complies with the requirement conditions of commercial-level cladding pipe technology.

From the evaluation results of the high-temperature deformation capability, it has been found that the G-phase Ni-based EHP alloy of the present embodiment fully satisfies the current standard of product performance, and by using the hot extrusion in a production process for existing commercial-level fuel cladding pipes, the mass-production of large quantities of the fuel-cladding pipes becomes possible, and the cost performance of commercial-level power generation reactors is satisfied.

(Product Performance of Precipitation-strengthened Ni-based Heat-resistant Alloy)

Next, the product performance of the G-phase Ni-based EHP alloy of the present embodiment will be described.

(Irradiation Resistance)

Regarding the irradiation resistance thereof, the G-phase Ni-based EHP alloy of the present embodiment hardens through irradiation at 500° C. or lower, but has the feature that the growth of secondary irradiation defects that would result in irradiation embrittlement hardly occurs, different from existing SUS316 steel. In addition, at 500° C. or higher, in an accelerator irradiation test of a triple ion beam of conservatively simulating the ejection damage in the neutral energy spectrum and formation of He and H through nuclear transmutation reaction in a fast reactor, and in an irradiation test using ultra-high-voltage electrons, it has been confirmed that any void swelling does not occur at all, and the alloy has excellent irradiation resistance.

FIG. 6 shows evaluation examples of comparing the G-phase Ni-based EHP alloy of the present embodiment and an existing comparative alloy in point of the irradiation resistance. As a result of co-irradiation up to 90 dpa with He and H formed through nuclear transmutation reaction at 550° C. using triple ion beams as a simulation of a fast reactor, it has been shown that PNC316 steel which is an existing material of fuel-cladding pipes for fast reactors has large quantities of voids formed therein, and a γ'-phase Ni-based EHP alloy tends to have voids formed therein under co-irradiation with He. However, in the G-phase Ni-based EHP alloy of the present embodiment, though it had a high Cr content, void formation was completely inhibited, and good void swelling resistance was shown. From these results, it is found that as the material of austenitic alloy for fuel-cladding pipes of fast reactors, the G-phase Ni-based EHP alloy of the present embodiment has the most excellent irradiation resistance.

(Heat Resistance)

Regarding the heat resistance, it is important that the alloy is free from both the reduction in the high-temperature creep strength and the reduction in the ductility. In existing SUS316 steel, the stability of the austenite phase is low, and therefore at high temperatures on a level of 700° C. and for a period of 10,000 hours or more, a brittle a phase is formed and the creep strength greatly lowers. On the other hand, ODS ferrite steel that is a candidate in FaCT (Implementation Technology Development Project for Liquid Metal Sodium-Cooled Fast Reactors in Japan) is basically a composite material of a mixture of an oxide and a carbide, and therefore its ductility is only a few % or less and is low, and any ternary creep region itself is not existed. On the other hand, PE16 and Inconel, which are commercial-level heat-resistant alloys, have a high creep strength, but γ' and $M_6C$ coarsen and impurities segregate in the grain boundary therein, and as a result, the ductility reduction of the alloys is extremely great.

In the G-phase Ni-based EHP alloy of the present embodiment, depending on the heat hysteresis and the irradiation condition, two phases of a W-rich phase and a Cr-rich phase are formed, and under heavy irradiation, three types of G phases of Ni silicide are formed, and the thermodynamic stability of the precipitates is high and therefore the precipitates do not coarsen. Although the high-temperature creep strength is lower than that of commercial-level Ni-based heat-resistant alloys along with the cleaning measure, but the requirement conditions of high-temperature creep strength for liquid metal sodium-cooled fast reactors or supercritical water-cooled reactors are still satisfied. In addition, the creep drawing is extremely large and the ternary creep elongation thereof is large, and therefore the safety latitude in material planning is large.

FIG. 7 shows evaluation examples of comparing the G-phase Ni-based EHP alloy of the present embodiment and an existing comparative alloy in point of the high-temperature creep properties. As in the left-hand chart, there is a tendency that the dependency of the stress-fracture lifetime of high-temperature creep of the G-phase Ni-based EHP alloy of the present embodiment is equal to or higher than that of the commercial-level planning strength, and the use conditions of fast reactors are satisfied. As in the right-hand chart, the G-phase Ni-based EHP alloy of the present embodiment has a sufficiently large creep drawing, and is therefore free from the problem of ductility reduction as in γ'-phase or ODS steel. Consequently, as an austenitic alloy material for fuel-cladding pipes for fast reactors, the G-phase Ni-based EHP alloy of the present embodiment is highly practicable.

(Corrosion Resistance)

Regarding the corrosion resistance, the G-phase Ni-based EHP alloy of the present embodiment contains Cr in an amount of 25 wt % that is sufficient for the formation of protective oxide film under low oxidative power conditions, while under high oxidative power conditions, W and Si compositely added effectively act for film formation, and therefore, the alloy has excellent corrosion resistance in all environments of the nitric acid dissolution process for used fuels in air under radiation action or in water vapor containing supercritical pressure steam and also in commercial-level reprocessing facilities.

FIG. 8 shows examples of corrosion resistance of the G-phase Ni-based EHP alloy of the present embodiment. The G-phase Ni-based EHP alloy of the present embodiment is a high-Cr alloy having a Cr content on a level of 25 wt %, and contains large quantities of protective film-forming elements such as W and Si, and has good corrosion resistance even in corrosion conditions with high-oxidative power as in dissolution with nitric acid in a dissolving tank for used fuels in wet-type reprocessing treatment, and accordingly, the alloy is fully applicable to corrosion environments of a nuclear fuel cycle process.

(Abrasion Resistance)

Regarding the abrasion resistance, the G-phase Ni-based EHP alloy of the present embodiment is superior to Stellite, which is the strongest one of existing alloys, and the alloy is favorably applicable to abrasion-resistant members of light-water reactors with which radioactivation by Co is an important problem.

Advantageous Effect

As described above, according to the precipitation-strengthened Ni-based heat-resistant alloy of the present embodiment and its production method, the void swelling depends on the stability of the austenite phase in the alloy. Accordingly, as a measure of increasing the stacking-fault energy that governs the easiness of void formation by lowering the electron hole concentration, it is indispensable to increase the Ni content. In consideration of the fact that, owing to the generation of radiation-induced segregation referred to as RIS under heavy irradiation condition, the Cr concentration in the grain boundary lowers by around 10% than that in the matrix, it is necessary to fully increase the Cr content. Consequently, the composition of the alloy is made to have a high Ni content and a high Cr content. The irradiation resistance and corrosion resistance can be secured by the control of the basic alloy composition.

The Ni-based heat-resistant alloy has great deformation resistance in the grain boundary, and therefore when the residual amount of impurities having a great effect of interfering with metal bonds, such as P, S, B, alkali metals and halogens that lower the mechanical properties in the grain boundary is high, then the sensitivity to solidification cracking or high-temperature cracking increases and the sensitivity thereof to grain-boundary stress corrosion cracking or hydrogen embrittlement in environment-induced cracking increases. Consequently, the total content of C, N, O, P and S is 0.01 wt % or less. Accordingly, the mechanical properties and corrosion resistance in the grain boundary can be secured.

An intermetallic compound for attaining dispersion precipitation strengthening that is important for keeping a high-temperature creep strength is required to have sufficient thermodynamic stability in a broad temperature range of up to 900° C. For the intermetallic compound capable of keeping high-temperature creep strength and being hardly dissolved under heavy irradiation, the γ' phase of PE16 and the like is unsuitable. Accordingly, from the knowledge that the stable precipitate of an austenitic stainless steel after heavy irradiation is a silicide referred to as G phase, Si itself has an effect of preventing void swelling, and of silicides, W—Si-based ones have the lowest solubility in a high-temperature range, tungsten silicide having high thermodynamic stability can be used as the intermetallic compound. The tungsten silicide is dispersed and precipitated within a range of from 20 to 40 vol %, and the grain size of the matrix austenite is controlled to be within a range of from No. 2 to No. 6 as the ASTM grain size number, whereby the high-temperature creep strength can be secured.

By using hot extrusion in the production process for existing commercial-level fuel-cladding pipes, mass-production of fuel-cladding pipes is possible, and therefore, the cost performance of commercial-level power generation reactors can be satisfied.

Consequently, it is possible to provide the precipitation-strengthened Ni-based heat-resistant alloy excellent in irradiation resistance, heat resistance, corrosion resistance and cost performance.

In a low- or middle-temperature range of from 250 to 450° C. in which the abrasion resistance is required, precipitates and grain boundaries effectively function as the barrier to mechanical strength and deformation resistance, and therefore, through thermo-mechanical treatment of a combination of cold working, aging precipitation treatment and middle- or high-temperature recrystallization, precipitation strengthening of the tungsten silicide and grain refining are attained. Accordingly, the applicability of the alloy to actual environments at from 250 to 450° C. in which the abrasion resistance is required can be secured.

In a middle- or high-temperature range of from 450 to 700° C. in which the high-temperature creep strength is required, creep deformation is governed by diffusive creep-governing grain boundary slipping, and therefore through thermo-mechanical treatment of a combination of cold working, solution treatment and aging precipitation treatment, precipitation strengthening of the tungsten silicide and grain refining are attained. Accordingly, the applicability of the alloy to actual environments at from 450 to 700° C. in which the high-temperature creep strength is required can be secured.

Modified Example of the Present Embodiment

Embodiments of the present invention have been described hereinabove, which, however, are to demonstrate some concrete examples of the present invention but are not intended to restrict the present invention. The concrete constitutions and the like of these embodiments may be suitably changed and modified. The actions and the advantageous effects of the present invention described in the embodiments of the present invention are to show merely the most favorable actions and advantageous effects of the present invention, and therefore the actions and the advantageous effects of the present invention are not limited to those described in the embodiments of the present invention.

For example, the total content of C, N, O, P and S is controlled to be 0.01 wt % (100 wppm) or less through an extra high purity ingot-forming method (EHP), however, the total content of C, N, O, P and S may be controlled to be 0.01 wt % or less through any other method than the extra high purity ingot-forming method.

Tungsten silicide is dispersed and precipitated through thermo-mechanical treatment, but tungsten silicide may be dispersed and precipitated by any other method than the thermo-mechanical treatment.

The silicide to be dispersed and precipitated is not limited to tungsten silicide, but may be $Ni_3Si$ or the like.

While the present invention has been described in detail and with reference to specific embodiments thereof, it will be apparent to one skilled in the art that various changes and modifications can be made therein without departing from the spirit and scope thereof.

This application is based on Japanese Patent Application No. 2010-266047 filed on Nov. 30, 2010, the entire subject matters of which are incorporated herein by reference.

Industrial Applicability

The precipitation-strengthened Ni-based heat-resistant alloy of the present invention is useful as a material for fuel-cladding pipes for fast reactors.

The invention claimed is:

1. A precipitation-strengthened Ni-based heat-resistant alloy, comprising, in terms of wt %, 0.03% or less of C,
0.5% or less of Mn,
0.01% or less of P,
0.01% or less of S,
from 2.0 to 3.0% of Si,
from 23 to 30% of Cr,
from 7.0 to 14.0% of W,
from 10 to 20% of Fe, and
from 40 to 60 wt % of Ni,
wherein a total content of C, N, O, P and S is 0.01 wt % or less, and
a silicide is dispersed and precipitated and a grain size of a matrix austenite is controlled to be a predetermined grain size.

2. The precipitation-strengthened Ni-based heat-resistant alloy according to claim 1, wherein the silicide is tungsten silicide.

3. The precipitation-strengthened Ni-based heat-resistant alloy according to claim 1, wherein the silicide is dispersed and precipitated within a range of from 20 to 40 vol %.

4. The precipitation-strengthened Ni-based heat-resistant alloy according to claim 2, wherein the silicide is dispersed and precipitated within a range of from 20 to 40 vol %.

* * * * *